United States Patent [19]

Samejima et al.

[11] Patent Number: 4,586,994

[45] Date of Patent: May 6, 1986

[54] ELECTROLYTIC PROCESS OF AN AQUEOUS ALKALI METAL HALIDE SOLUTION AND ELECTROLYTIC CELL USED THEREFOR

[75] Inventors: Yasushi Samejima, Kakogawa; Minoru Shiga, Himeji; Toshiji Kano, Kakogawa; Kiyoshi Yamada, Kobe, all of Japan; Tsutomu Nishio, deceased, late of Kakogawa, Japan, by Haruko Nishio, legal representative

[73] Assignee: Kanegafuchi Kagaku Kogyo Kabushiki Kaisha, Osaka, Japan

[21] Appl. No.: 558,661

[22] Filed: Dec. 6, 1983

[30] Foreign Application Priority Data

| | | | |
|---|---|---|---|
| Dec. 6, 1982 | [JP] | Japan | 57-213729 |
| Feb. 17, 1983 | [JP] | Japan | 58-25350 |
| Mar. 31, 1983 | [JP] | Japan | 58-57099 |
| Apr. 13, 1983 | [JP] | Japan | 58-66198 |

[51] Int. Cl.[4] ..... C25B 1/16

[52] U.S. Cl. ..... 204/98; 204/128; 204/237; 204/251; 204/263; 204/266

[58] Field of Search ..... 204/98, 128, 237, 251, 204/263, 266

[56] References Cited

U.S. PATENT DOCUMENTS

| | | | |
|---|---|---|---|
| 3,770,611 | 11/1973 | Barnabé | 204/98 |
| 3,864,226 | 2/1975 | Spitzer | 204/98 |
| 3,893,897 | 7/1975 | Raetzsch et al. | 204/98 |
| 3,976,550 | 8/1976 | De Nora et al. | 204/98 |
| 4,036,714 | 7/1977 | Spitzer | 204/98 |
| 4,065,367 | 12/1977 | De Nora | 204/128 |
| 4,101,407 | 7/1978 | Hilaire et al. | 204/251 |

*Primary Examiner*—John F. Niebling
*Assistant Examiner*—Terryence Chapman
*Attorney, Agent, or Firm*—Armstrong, Nikaido, Marmelstein & Kubovcik

[57] ABSTRACT

Disclosed is an electrolytic process using a horizontal type cation exchange membrane electrolytic cell in which catholyte liquor is supplied into a cathode compartment with initial linear velocity of at least 8 cm/sec and gas content of at most 0.6 at a catholyte liquor outlet. Also disclosed is an electrolytic cell used for the foregoing process. The invention enables not only conversion of a mercury electrolytic cell to a cation exchange membrane electrolytic cell with low cost, but the long-term and stable operation.

13 Claims, 17 Drawing Figures

ELECTROLYTIC PROCESS OF AN AQUEOUS ALKALI METAL HALIDE SOLUTION AND ELECTROLYTIC CELL USED THEREFOR

BACKGROUND OF THE INVENTION

1. Field of the Invention

The present invention generally relates to an electrolytic process and electrolytic cell for electrolysis of an aqueous alkali metal halide solution, especially an aqueous alkali metal chloride solution. More particularly, it relates to a process and apparatus for mainly obtaining a high purity caustic alkali more effectively with low cell voltage using a horizontal type electrolytic cell providing a cation exchange membrane as an electrolytic separator.

2. Description of Prior Art

The most typical horizontal electrolytic cell is a mercury electrolytic cell; however, these are destined to be shut down in the near future since mercury, used as a cathode, contaminates the environment. When such a mercury cathode electrolytic cell is desired to be converted into a separator electrolytic cell employing no mercury with a reduced cost, the separator electrolytic cell should be of a horizontal type. In view of the situation, it is a significant matter the industry is now encountering to develop a process for producing a high purity product, not inferior to a product by the mercury process, with a high current efficiency using such horizontal type separator electrolytic cells.

A process for remodeling a mercury cell to a horizontal type separator cell is revealed in the U.S. Pat. No. 3,923,614. In the process, however, a porous membrane (diaphragm) is used to serve as a separator, having great water permeability and accordingly anolyte solution passes through the separator hydraulically to thus mingle in, for example, caustic alkali produced in the cathode compartment, thereby resulting in decreased purity.

On the other hand, a cation exchange membrane called a non-porous membrane permits no passage of anolyte solution or catholyte liquor hydraulically, allowing only water molecules coordination-boned to alkali metal ions transported electrically to pass, hence a high purity caustic alkali being obtained. To the contrary, a small quantity of water transported evaporates to cause electric conduction failure between a membrane and a cathode, in the long run to terminate electrolytic reaction.

The U.S. Pat. No. 3,901,774 proposes processes to solve these problems; one is a process for placing a liquid maintaining material between a cation exchange membrane and a cathode and another is a process for carrying out the electrolysis while supplying to a cathode an aqueous caustic alkali liquor in mist or spray.

Notwithstanding, the former process not only involves the problems including troubles for interposing the liquid maintaining material and the durability thereof, but increases cell voltage because the distance between electrodes is expanded by the liquid maintaining material located between the cation exchange membrane and the cathode, besides an increase in electric resistance of the liquid maintaining material per se. Hence it can not be an advantageous process. Moreover the latter process has some difficulties in practice on an industrial scale since the uniform supply of liquid is difficult when applied to a large-scale electrolytic cell such as employed commercially.

In an attempt to eliminate the foregoing defects attendant on the conventional processes, a process and apparatus therefor has been proposed by Ser. No. 434,737 (EPC Appln. No. 82109528). This proposal involves a process for enfolding hydrogen gas generated on a cathode in a catholyte liquor stream to thereby remove hydrogen gas from a cathode compartment, and electrolytic cell which is characterized by an upper anode compartment and a lower cathode compartment partitioned by a cation exchange membrane positioned substantially horizontal, said anode compartment having therein substantially horizontal anodes and being surrounded by the top cover, side walls positioned so as to enclose the anodes and the upper side of the membrane, and being provided with an inlet and an outlet of anolyte solution and an outlet of anode gas, said cathode compartment being surrounded by a cathode plate having gas-liquid impermeability, side walls so as to enclose the cathode plate and the underside of the membrane, and being provided with an inlet of catholyte liquor and an outlet of a mixed stream of the cathode gas and the catholyte liquor.

In carrying out the electrolysis using such type construction cell, it is, first of all, an exceedingly essential point to cause cathode gas generated in the cathode compartment to be rapidly enfolded in the catholyte liquor stream and to prevent gas-liquid separation in the cathode compartment. In this point, the initial linear velocity of catholyte liquor supply to the cathode compartment has a close bearing on the residence of gas and cell voltage and high purity caustic alkali can be obtained with low cell voltage without residence of gas by controlling the initial linear velocity in the cathode compartment to about 8 cm/sec or more. Even when, however, the initial linear velocity is maintained at 8 cm/sec or more, fine gas bubbles aggregate with an increase of gas to thus cause gas-liquid separation within the cathode compartment, and gas layer separated from liquid covers the underside of the membrane to result in an increase in cell voltage. Moreover, the gas prevents long-term and stable operation because of vibration of the membrane caused by the intermittent withdrawal of gas separated and damages the membrane in the end.

Secondly, in effecting the electrolysis while circulating the catholyte liquor along the longitudinal way of the cathode plate, it has been made clear the following problems occur. That is: (a) With the linear velocity of 50 cm/sec at an inlet of the catholyte liquor, pressure difference ($\Delta p$) between the cathode compartment and the anode compartment at the neighborhood of the catholyte liquor inlet becomes about 0.3 $Kg/cm^2$ and the load ammounting to several tens tons is imposed on the whole cathode compartment. As a result, the cathode plate, a DSE (dimensionally stable electrode) and a cell cover are not only deformed, the distance between electrodes being expanded to thus raise cell voltage, but the membrane is damaged. On the other hand, to prevent such deformation of the cathode plate, the DSE and the cell cover, reinforcement is required, thereby leading to a complicated structure as well as increased cost; (b) $G/(L+G)$ (content of cathode gas contained in unit volume of a mixture of cathode gas and the catholyte liquor) of the catholyte liquor increases to thus raise electric resistance of the mixed stream consisting of the catholyte liquor and the cathode gas, in consequence, current distribution takes place in a longitudinal direction of the cathode plate. For instance, at current density of 20 $A/dm^2$ $\Delta CV$ (difference in cell voltage between at the inlet and the outlet of the catholyte liquor) reaches approximately 40 mV; (c) Fine gas bubbles aggregate in the mixed stream to thus cause gas-liquid separation which permits a pulsating flow to occur. For this reason, $\Delta p$ varies to thus vibrate the membrane and when the distance between electrodes is small, contact and separation of the membrane and the electrodes is repeated, thereby resulting in damage of the membrane.

Thirdly, because of pressure loss generated from the catholyte liquor inlet to the catholyte liquor outlet, the pressure of the catholyte liquor is high in the vicinity of the catholyte liquor inlet and becomes close to zero in the vicinity of the catholyte liquor outlet. Therefore, in the vicinity of the catholyte liquor outlet a slight change in pressure between the anode and cathode compartments permits the cation exchange membrane to vibrate and occasionally injures the membrane in a form of a crack, wear, pin-holes and the like during operation for a long period of time. A change in pressure imposed on the cation exchange membrane takes place, for example, when the mixed stream of the cathode gas and the catholyte liquor partly causes gas-liquid separation in the neighborhood of the catholyte liquor outlet to thus permit the residence of gas, whereby pulsating flow is partly brought about.

Fourthly, when the catholyte liquor is introduced and removed parallel to a circulating direction thereof, the inlet (19) and the outlet (20) are usually positioned between the membrane (3) and the cathode plate (16), namely, to side walls of the cathode compartment, as illustrated by FIG. 6. Accordingly, even though the membrane-cathode plate distance is desired to be smaller than the space of the inlet or outlet, various difficulties arise and when practiced daringly, the structure is complicated and equipment cost is increased.

Furthermore, it has been found by the inventors that in a liquid-contacting and electric current-nonpassing portion of the membrane (non-electrolysing portion), NaOH migrates, for instance, in electrolysis of an aqueous NaCl solution, through the membrane into the anolyte solution to thus reduce solubility of NaCl in the anolyte solution, NaCl being therefore deposited on the membrane. The liquid-contacting and current-nonpassing portion means a portion in contact with the anolyte solution and/or the catholyte liquor and substantially not opposing the anode plate and the cathode plate, where substantially no electrolysis takes place. This phenomenon, as shown by FIG. 7, is apt to occur at a portion where the membrane (3) is sandwitched between a flange (5*a*) and a side wall (17) of the cathode compartment. NaCl deposited on the membrane not only presses down the membrane to thus change the electrodes-membrane distance, but also induces the membrane to vibrate and sometimes damages it owing to collision of the membrane and the electrodes. Moreover the phenomenon varies the flow rate of the catholyte liquor in the cathode compartment. When the foregoing phenomenon takes place in the neighborhood of the catholyte liquor inlet and the mixed stream outlet, those inlet and outlet are choked and pressure loss resulting from the flow of the catholyte liquor is increased. As a result, long-term and stable operation is impossible.

SUMMARY OF THE INVENTION

An object of the present invention is to obtain a high purity caustic alkali with high efficiency using a horizontal type separator electrolytic cell.

Another object of the present invention is to provide an improved horizontal type separator electrolytic cell with high performance providing a cathode of a new structure.

A further object of the present invention is to provide a horizontal type separator electrolytic cell with high performance, a horizontal type cation exchange membrane electrolytic cell, in particular, made by remodeling a mercury electrolytic cell.

Other objects of the present invention will be made apparent from the following description.

DETAILED DESCRIPTION OF THE INVENTION

The present invention is concerned with an electrolytic process by the use of a horizontal electrolytic cell partitioned by a cation exchange membrane positioned substantially horizontal into an upper anode compartment and a lower cathode compartment, said cathode compartment having therein a gas-liquid impermeable cathode plate, wherein electrolysis is effected while maintaining the specific initial linear velocity of catholyte liquor and the specific gas content of the catholyte liquor in the vicinity of a catholyte liquor outlet.

In the present invention, the initial linear velocity hereby means the following. That is, the catholyte liquor supplied into the cathode compartment entrains gas evolved by the electrolysis while flowing in the cathode compartment so that the velocity of the catholyte liquor flow generally increases as approaching to the outlet. Hence, the linear velocity of the catholyte liquor containing no gas in the neighborhood of the catholyte liquor inlet or containing a small amount of gas, if any, is called the initial linear velocity.

That is, the initial linear velocity means the linear velocity of the catholyte liquor in the case where no gas is substantially generated. The initial linear velocity equals the linear velocity in the vicinity of the catholyte liquor inlet when the cross-sectional area of the passageway of the catholyte liquor is substantially the same over the passageway. But, when the cross-sectional area is not the same, the initial linear velocity is represented by the average linear velocity of the catholyte liquor in the case accompanying no generation of gas.

Figure 1:
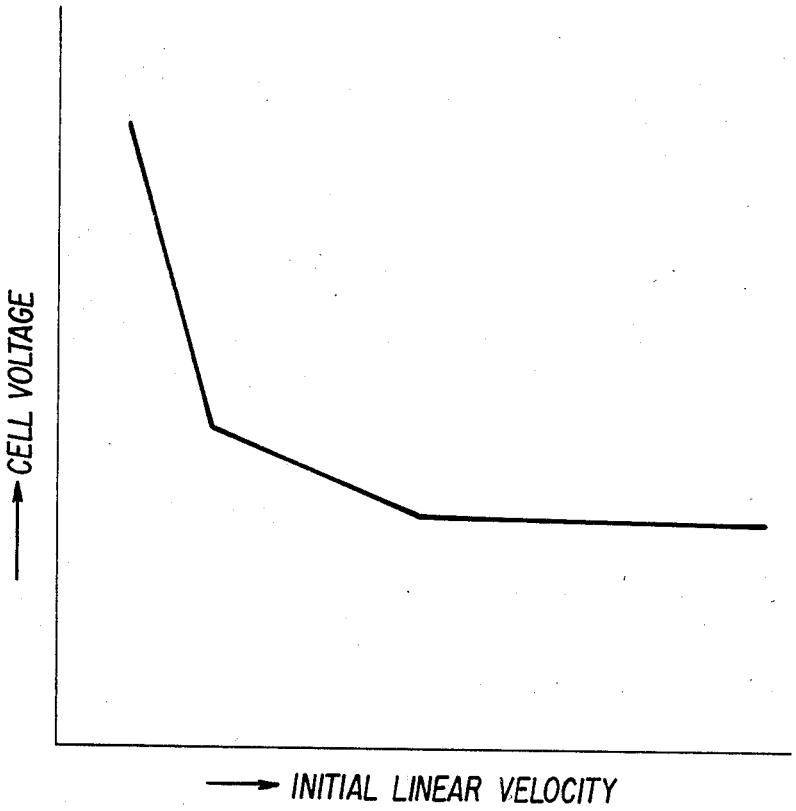
FIG. 1 is a graph showing the relative relationship between initial linear velocity and cell voltage.

In FIG. 1, there is shown a graph showing the relationship between initial linear velocity and cell voltage.

As is apparent from FIG. 1, the voltage decreases abruptly with an increase in velocity of the catholyte liquor supplied, then decreases gradually, thereafter arrives at the steady state approximately. It has been made clear by the present inventors that bending points of the curve as seen in FIG. 1 have almost no connection with the current density and appear at approximately the same velocity of flow in a general current density range between about 10 A/dm$^2$ and about 70 A/dm$^2$. The abrupt decrease of voltage up to the first bending point is supposed to take place because of a rapid reduction in the residence of gas on the underside of the cation exchange membrane with an increase in the velocity. The slow decrease of voltage from the first bending point to the second bending point is probably by a decreased deposition of gas onto the surfaces of the cathode and the cation exchange membrane with an increase in the velocity.

According to the results of study made by the present inventors, the first bending point appears at the initial linear velocity of about 8 cm/sec or more, and the second bending point appears at about 20 cm/sec or more.

Therefore, in obtaining a high purity caustic alkali with high efficiency at a low cell voltage in accordance with the process of the present invention it is necessary to operate maintaining the initial linear velocity of the catholyte liquor supplied into the cathode compartment placed under the cation exchange membrane positioned substantially horizontal at about 8 cm/sec or more, more preferably about 20 cm/sec or more.

A second condition for continuing the long-term and stable operation is to control the gas content R to 0.6 or less in the vicinity of the catholyte liquor outlet in the cathode compartment.

The gas content R is represented by the following equation;

$$R=G/(L+G)$$

wherein G is an amount of cathode gas generated (m$^3$/Hr) which is calculated by 0.418 (electrochemical equivalent)×KAH (Kiloampere-Hour)×358/273 (compensation of temperature in the case of electrolysis at 85° C.), and L is the flow rate (m$^3$/Hr) of the catholyte liquor.

As stated above, when the electrolysis is effected while maintaining the initial linear velocity of the catholyte liquor in the cathode compartment at 8 cm/sec or more and the gas content in the vicinity of the catholyte liquor outlet at 0.6 or less, the specific electric resistance and voltage drop of the catholyte liquor are reduced and the long-term and stable operation becomes possible at low cell voltage without damage of the membrane. The current density is between 10 A/dm$^2$ and 70 A/dm$^2$.

In cases where the gas content R is more than 0.6, even when the initial linear velocity is held not less than 8 cm/sec, cell voltage not only increases since the content of gas in unit volume of catholyte liquor increases and consequently electricity-passing portion decreases, but fine gas bubbles aggregate to result in gas-liquid separation and gas separated covers the underside of the membrane and raises cell voltage. The separated gas and catholyte liquor cause a pulsating flow permitting the membrane to vibrate in the neighborhood of the catholyte liquor outlet. The vibration damages the membrane and hence makes impossible the long-term operation. Moreover, since the vibration is transported to anodes and further transported to a cell cover through a conducting rod, the cell cover per se has to be strengthened. Furthermore, when the gas content R is great in the vicinity of the catholyte liquor outlet, electric resistance of the catholyte liquor becomes great therefore current distribution is unavoidable, affording an adverse effect to electrolytic performances.

Hereinbelow, the invention will be described by way of experiments.

EXPERIMENTS 1-3

An aqueous sodium chloride solution was electrolysed using a horizontal cation exchange membrane cell.

As a cation exchange membrane, "NAFION 901 (Registered trademark, manufactured and sold by E. I. Du Pont de Nemours & Company)" was positioned substantially horizontal between anode and cathode electrodes of a horizontal type electrolytic cell, 1.8 m in length and 70 cm in width.

As the anode, a titanium expanded metal whose surface is coated with $RuO_2$ and $TiO_2$ was employed and the anode-cathode distance was 2 mm. To the anode compartment a depleted brine was partly recirculated and concentration of the depleted brine was controlled to 3.5N, while catholyte liquor was recirculated in a longitudinal direction so that concentration of caustic soda was controlled to 32%. The temperature was adjusted to 85° C. Current density, the flow rate of catholyte liquor and the initial linear velocity were as follows;

| Experiments | Current density (A/d m$^2$) | Flow rate (m$^3$/Hr) | Initial linear velocity (cm/sec) |
|---|---|---|---|
| 1 | 10 | 0.5~7 | 10~140 |
| 2 | 40 | 0.9~9 | 18~180 |
| 3 | 70 | 1.6~9.8 | 32~194 |

Figure 2:
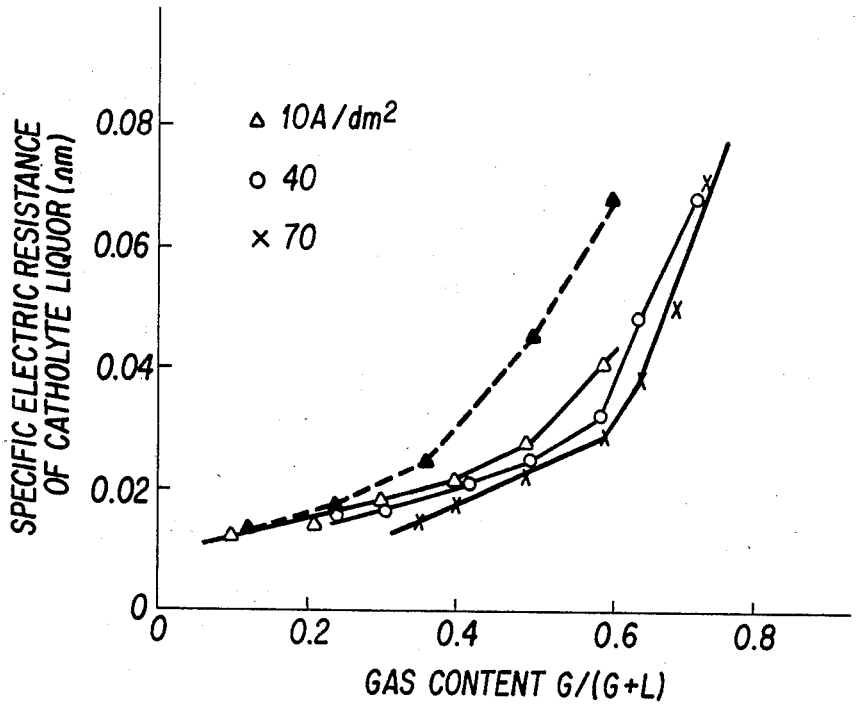
FIG. 2 is a graph showing the relationship between gas content and specific electric resistance of catholyte liquor.

The relationship between gas content and specific electric resistance of catholyte liquor was depicted in a solid line in FIG. 2. The specific electric resistance of catholyte liquor decreases when the gas content is not more than 0.6, and is approximately in equilibrium at not more than 0.4.

EXPERIMENTS 4–6

The experiments were effected in a similar manner to that of Experiments 1–3, except that using the cell, 10 m in length and 10 cm in width, having the anode-cathode distance of 4 mm, the flow rate was varied as below.

| Experiments | Current density (A/d $m^2$) | Flow rate ($m^3$/Hr) | Initial linear velocity (cm/sec) |
|---|---|---|---|
| 4 | 10 | 0.3~5.5 | 21~380 |
| 5 | 30 | 0.4~5.0 | 28~350 |
| 6 | 50 | 0.7~8.3 | 49~580 |

Figure 3:
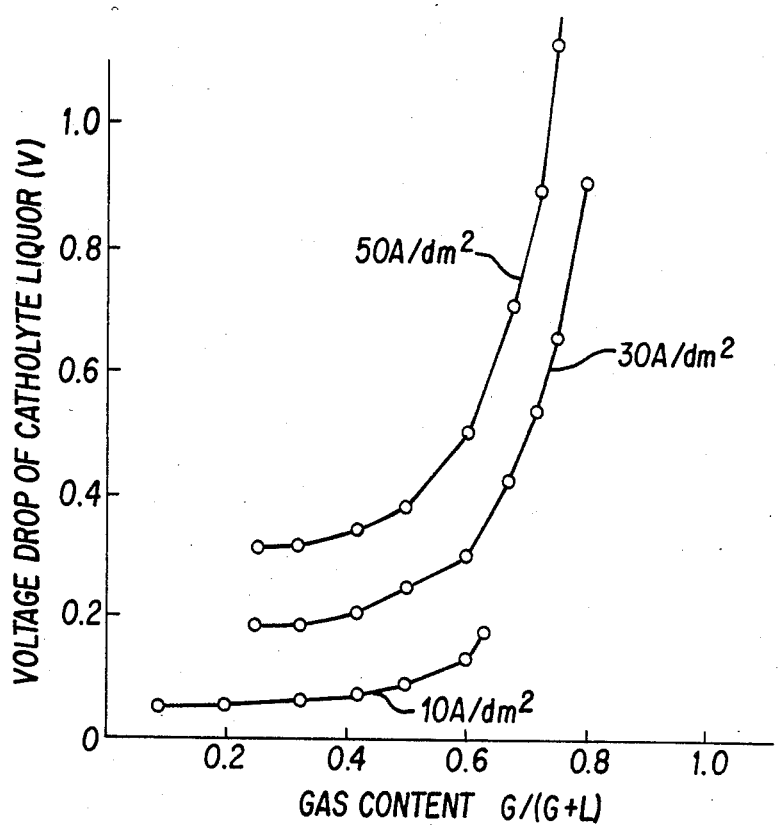
FIG. 3 is a graph showing the relationship between gas content and voltage drop of catholyte liquor.

The relationship between gas content and voltage drop of catholyte liquor was shown in FIG. 3. The voltage drop of catholyte liquor decreases with the gas content of not more than 0.6, and reaches approximately equilibrium with the gas content of not more than 0.4.

EXPERIMENT 7

Figure 4:
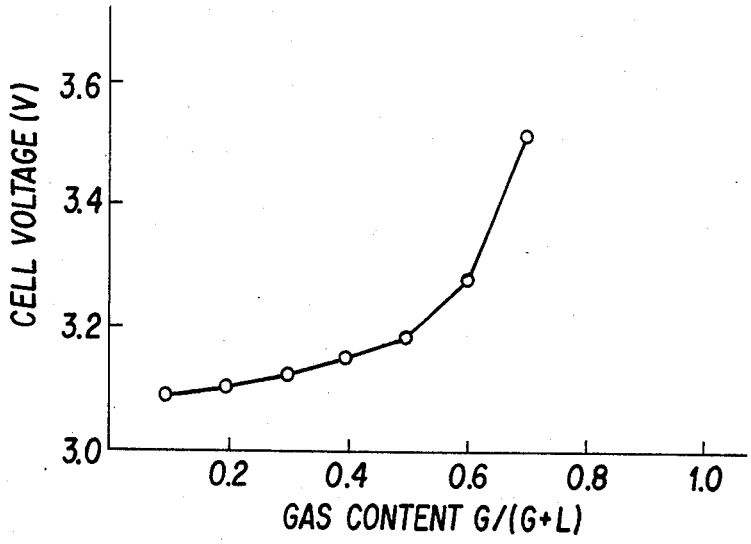
FIG. 4 is a graph showing the relationship between gas content and cell voltage.

Between anode and cathode electrodes of a horizontal type electrolytic cell having the length of 11 m and the width of 1.8 m, "NAFION 901" was positioned substantially horizontal. The same anode as in Experiments 1 to 3 was used and the anode-cathode distance was 3 mm. Current density was 30 A/$dm^2$ and catholyte liquor was recirculated transversely to the longitudinal direction, the conditions such as circulation of electrolytes and concentration being the same as in Experiments 1 to 3. The relationship between gas content and cell voltage varying flow rate in a range of from 15 to 310 $m^3$/Hr and initial linear velocity in a range of from 13 to 250 cm/sec was given by FIG. 4. It is apparent from FIG. 4 that with the gas content of not more than 0.6 the cell voltage is reduced and approximately arrived at equilibrium with the gas content of not more than 0.4. The operation was further continued for 5 months at current density of 30 A/$dm^2$ and at the flow rate of 70 $m^3$/Hr. The gas content was 0.32, the voltage was 3.12 V and current efficiency was 96%. During the course of electrolysis, vibration of the membrane could hardly be observed and after operataion no damage of the membrane could be recognized.

EXPERIMENT 8

The experiment was repeated similarly to Experiment 1 with exception that a cell with the anode-cathode distance of 4 mm was used. The relationship between gas content and specific electric resistance of the catholyte liquor was shown in a broken line in FIG. 2. FIG. 2 exhibits that even when the gas content is not more than 0.6, the electric specific resistance increases when the initial linear velocity of the catholyte liquor is less than 8 cm/sec, because the anode-cathode distance was expanded to twice to thereby reduce the initial linear velocity to about half, as compared with Experiment 1.

In practicing the present invention, it is very effective for preventing vibration of the membrane and consequently extending the lifetime to effect the electrolysis while pressing a portion of the membrane substantially taking part in the electrolysis against anodes. The pressing of the membrane against the anodes may be attained by known processes. For example, by closing a valve provided to the catholyte liquor outlet, pressure can be imposed on the whole cathode side of the membrane. It may also be achieved by the pressure of hydrogen gas generated on the cathode. It may further be attained by attracting the membrane to the anode side with increased sucking force of anode gas.

The positive pressure imposed on the cathode side of the cation exchange membrane in the vicinity of the catholyte liquor outlet, i.e., difference in pressure on the membrane between the anode side and the cathode side should be greater than a change in pressure imposed on the membrane. Under the general electrolytic conditions, i.e., at current density ranging from 5 to 80 A/$dm^2$ and at the length in a cathode liquor-circulating direction of the cathode compartment ranging from 1 to 15 m, it has been discovered by the inventors that a change in pressure is between about 100 mm $H_2O$ and about 1000 mm $H_2O$. Accordingly the difference in pressure required to be imposed on the membrane is at least about 100 mm $H_2O$ and not exceeding about 10 m $H_2O$. The difference in pressure exceeding about 10 m $H_2O$ is to press the membrane against the anodes with force stronger than required and hence leads to damage of the membrane.

Moreover, an increase in cell voltage, damage of the membrane, deformation of the DSE and the cell cover, current distribution, gas-liquid separation in the cathode compartment and the like may be minimized by supplying the catholyte liquor into the cathode compartment from one of long sides of the cathode plate, forming a mixed stream of the catholyte liquor and cathode gas, with which the underside of the membrane is wetted, and then removing the mixed stream from the opposite long side. Further, when at least a part of the mixed stream removed is recirculated back as catholyte liquor to the cathode compartment, an amount of catholyte liquor recirculated may not only be reduced, but concentration of catholyte liquor may be made uniform and adjusted to a desired concentration.

Still more, when catholyte liquor is introduced through a flange of a side wall of the anode compartment or a periphery of the cathode plate opposite the flange in a substantially vertical direction of the horizontal surface of the cathode plate, and the mixed stream is removed through another flange or another periphery in a substantially vertical direction similarly, vibration and damage of the membrane may be effectively avoided. Furthermore, it is very advantageous to conduct electrolysis while preventing and electrolyte of anolyte solution from deposition on a liquid-contacting and electricity-nonpassing portion of the membrane opposing flanges of side walls of the anode compartment, because changes in the electrodes-membrane distance and vibration or damage of the membrane may be prevented, the anode-cathode distance may be reduced and further pipe arrangement may be easily made.

Hereinafter, embodiments of the present invention will be explained in detail by referring to the drawings attached. The following explanation is referred, as a matter of convenience, to sodium chloride which is most popular in the industry and typical of alkali metal halides, and to caustic soda as an electrolytic product, but to which the present invention is not limited, the present invention being, needlessly, applied to the electrolysis of an aqueous solution of other inorganic salts, water and the like.

Figure 8:
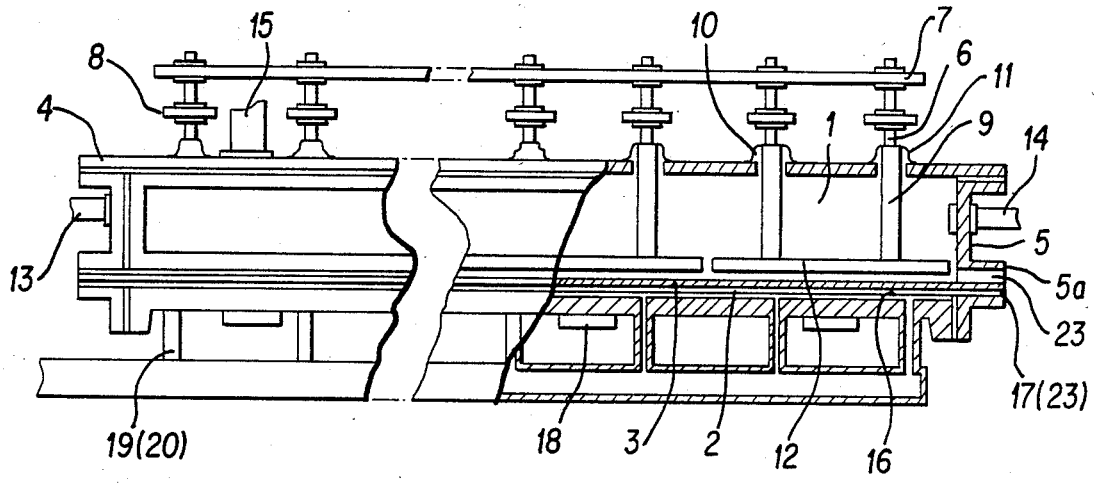
FIG. 8 is a partial cutaway front view illustrating another embodiment of the present electrolytic cell.
Figure 9:
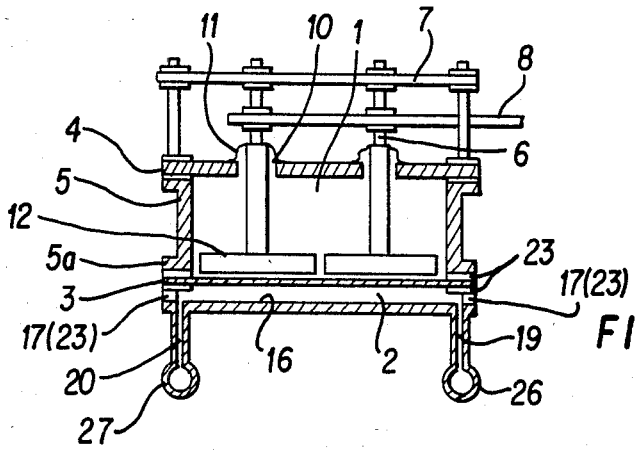
FIG. 9 is a side sectional view of the electrolytic cell shown by FIG. 8.

FIG. 8. and FIG. 9 are a partial cutaway front view and a side sectional view, respectively, showing an electrolytic cell of the present invention.

In FIG. 8 and FIG. 9, an electrolytic cell of the present invention is comprised of an anode compartment (1) and a cathode compartment (2) located thereunder, both compartments being of a rectangular shape having the greater length than the width, preferably several times the length. The anode compartment (1) and the cathode compartment (2) are separated from each other by a cation exchange membrane (3) positioned substantially horizontal between side walls of the compartments. The word "substantially horizontal" also includes the cases where the membrane is positioned slightly slant (up to a slope of about 2/10).

The cation exchange membrane used suitably in the present invention includes, for example, membranes made of perfluorocarbon polymers having cation exchange groups. The membrane made of a perfluorocarbon polymer containing sulfonic acid groups as a cation exchange group is sold by E. I. Du Pont de Nemours & Company under the trade mark "NAFION" having the following chemical structure;

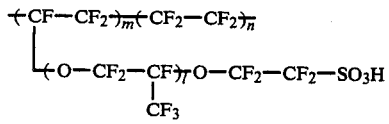

The equivalent weight of such cation exchange membranes is preferred in a range between 1,000 and 2,000, more preferably in a range between 1,100 and 1,500. The equivalent weight herein means weight (g) of a dry membrane per equivalent of an exchange group. Moreover membranes whose sulfonic acid groups are substituted, partly or wholly, by carboxylic acid groups and other membranes widely used can also be applied to the present invention. These cation exchange membranes exhibit very small water permeability so that they permit the passage of only sodium ion containing three to four molecules of water, while hindering the passage of hydraulic flow.

The anode compartment (1) is formed by being surrounded by a top cover (4), side walls (5) of the anode compartment located so as to enclose anode plates (12) suspended from the top cover (4) and the upper side of a cation exchange membrane (3). The anodes conducting rods (6) are suspended by anode-suspending devices (7) located on the top cover (4) and are connected to one another by an anode busbar (8). The top cover (4) possesses holes (10) through which anode conducting rod covers (9) are inserted and the holes (10) are sealed airtight by sheets (11). To the lower ends of the rod covers (9), are anode plates (12) secured. As such, the anode plates (12) are connected to the anode-suspending devices (7), so that those can be ascended and descended by the adjustment of the anode-suspending devices (7), thereby being positioned so as to come into contact with the cation exchange membrane (3). Of course, the anodes may also be suspended by other means, not being limited to the cases where those are suspended from the anode-suspending devices positioned to the top cover. For instance, the anodes may be suspended by being secured to an anode compartment frame which is fabricated of the top cover and the side walls, united in one body. Moreover the anode compartment is provided with at least one anolyte solution inlet (13), which may be positioned to the top cover (4) or side walls (5) of the anode compartment. On the other hand, at least one anolyte solution outlet (14) is provided and may be positioned to the side walls (5). Furthermore, to a suitable place of the top cover (4) or the side walls (5), anode gas (chlorine gas) outlet (15) is provided. In this case, when anode gas is discharged with anolyte solution, the anode gas outlet (15) may be omitted.

As the material for the top cover (4) and side walls (5) forming the anode compartment (1), a top cover and side walls of an anode compartment of a mercury electrolytic cell may also be diverted and any chlorine-resistant material may be effectively used. Examples of such materials are chlorine-resistant metals such as titanium and an alloy thereof, fluorocarbon polymers, hard rubbers and the like. Moreover iron lined with the foregoing metals, fluorocarbon polymers, hard rubbers and the like may also be employed.

As the anode plate (12) on which the anode reaction takes place, a graphite anode may also be used, but an insoluble anode made of metals such as titanium and tantalum coated with platinum group metals, platinum group metal oxides or mixtures thereof is preferred to use. Of course, anode plates used in a mercury electrolytic cell may be directly diverted without altering dimensions and shapes.

The cathode compartment (2), on the other hand, is formed by being surrounded by the underside of the cation exchange membrane (3), a cathode plate (16) and side walls (17) of the cathode compartment positioned so as to enclose the cathode plate along the periphery of the cathode plate. The side walls (17) of the cathode compartment may be made of those such as frames having some rigidity or may also be made of those such as packings of rubbers, plastics and the like. Furthermore, the portion of the bottom plate opposing the anodes through the cation exchange membrane is shaved off except the periphery and the remaining bank-like periphery of the cathode plate is served as the side walls of the cathode compartment. Moreover the cathode compartment may be formed as below; That is, a thin layer packing is placed on the periphery of the cathode plate, the anode plates are located upper than the lower flange level of side walls forming the anode compartment and the cation exchange membrane is located along the iniside surfaces of the side walls of the anode compartment utilizing the flexibility of the membrane to thus form the cathode compartment.

As the material for the side walls (17) of the cathode compartment, any material resistant to caustic alkali such as sodium hydroxide may be used including, for example, iron, stainless steel, nickel and an alloy thereof. Iron base material lined with alkali-resistant materials may also be suitably used. Materials such as rubbers and plastics may also be used. As those materials, there are exemplified rubbers such as natural rubber, butyl rubber and ethylene-propylene rubber (EPR), fluorocarbon polymers such as polytetrafluoroethylene, copolymers of tetrafluoroethylene and hexafluoropropylene and copolymers of ethylene-tetrafluoroethylene, polyvinyl chloride and reinforced plastics.

The cathode plate (16) used in the present invention possesses the gas-liquid impermeability. One of preferable embodiments is a cathode plate having a substantially flat surface and it may form, by itself, a part of walls (bottom wall) of the cathode compartment. The word "substantially flat surface" herein means such as degree that flowing of mixed stream of catholyte liquor and cathode gas might not be prevented or hindered, and thus requiring no specific flattening by mechanical processing and the like. The cathode plate may be made of electroconductive materials such as iron, nickel and stainless steel. Moreover those materials, the surfaces of which were subjected to plasma flame spray with nickel or silver, or plated with a nickel alloy to reduce hydrogen overvoltage may be used. Furthermore, by providing on the cathode plate at suitable intervals a plurality of partitions for control of catholyte liquor, flow of the mixed stream may be rectified smoothly and vibration of the membrane due to changes in pressure may be prevented.

An inlet of catholyte liquor is provided to one of long sides of the cathode plate or a side wall thereabove and an outlet of a mixed stream of catholyte liquor and cathode gas is provided to the opposite long side or a side wall thereabove, so as to permit the catholyte liquor or the mixed stream to flow transversely to the longitudinal direction of the cathode plate. In FIG. 8 and FIG. 9, the catholyte liquor inlet (19) and the mixed stream outlet (20) are provided respectively, to peripheries of the cathode plate (16) opposing flanges (5*a*) of the anode compartment side walls so that the catholyte liquor is introduced and the mixed stream is removed in a substantially vertical direction to the horizontal surface of the cathode plate (16). By so designed, changes in pressure resulting from introduction of catholyte liquor and removal of the mixed stream and vibration of the membrane may be minimized. The catholyte liquor inlet (19) and the mixed stream outlet (20) are in communication with a catholyte liquor introduction header (26) and a mixed stream removal header (27), respectively.

Figure 10A:
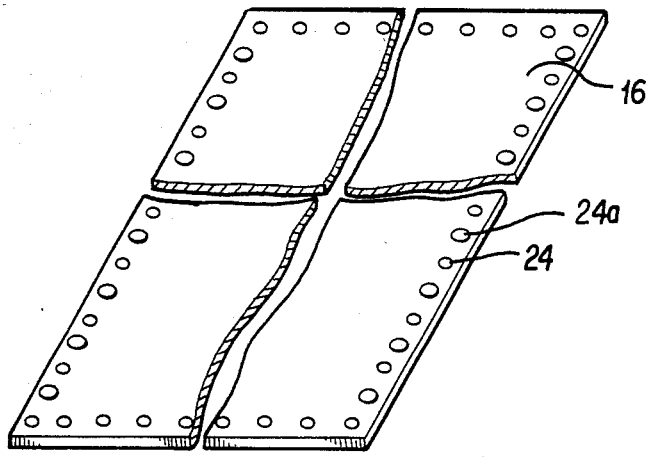
FIG. 10 (A) is a perspective view of a cathode plate remodeled from a bottom plate used in a mercury electrolytic cell and FIG. 10 (B) is a partial schematic illustration exhibiting assembly of an electrolytic cell.
Figure 10B:
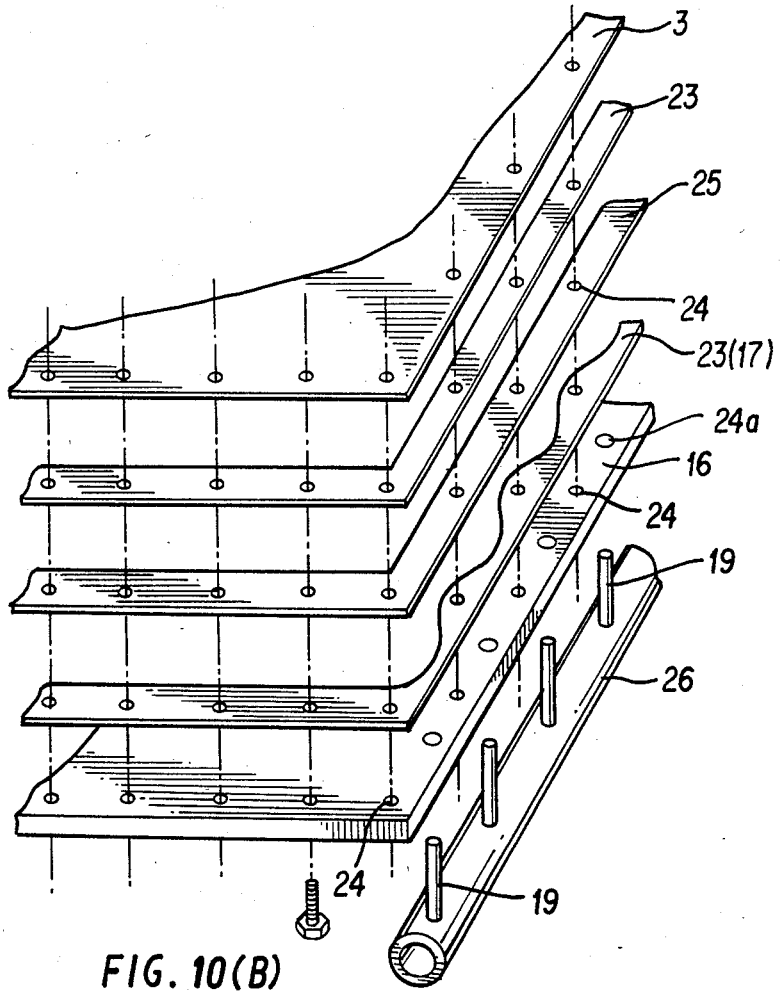

FIG. 10 shows another embodiment of the present invention in which a bottom plate used in a mercury electrolytic cell is diverted as a cathode plate of the present electrolytic cell. FIG. 10 (A) is a perspective view of a cathode plate remodeled from bottom plate used in a mercury electrolytic cell and FIG. 10 (B) is a partial schematic illustration showing assembly of an electrolytic cell. In these figures, on peripheries of the cathode plate (16) comprised of a bottom plate of a mercury electrolytic cell, a rectangular flame-shaped packing (23) having opposite concave-convex insides and bolt holes at convex partitions are placed, so that concave portions are located to the vicinity of bolt holes (24*a*) of the cathode plate served as the inlet of catholyte liquor or the outlet of the mixed liquor, and convex portions are located on bolt holes (24) served for assembling of the cell.

Figure 11A:
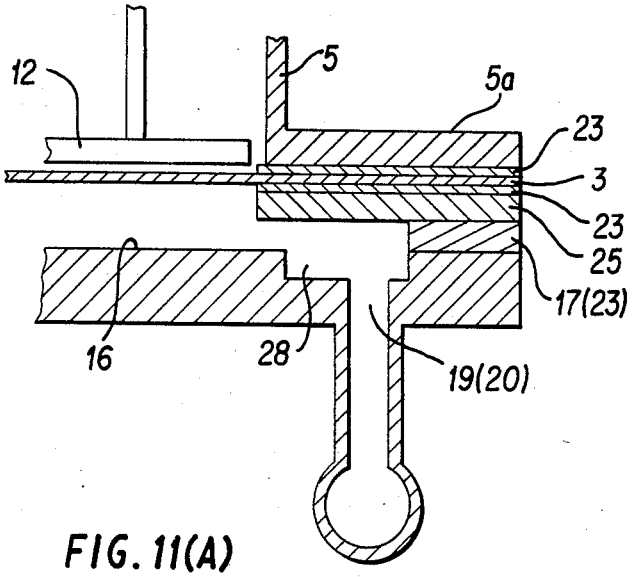
FIG. 11 (A) is an enlarged sectional view of the principal portion in which the vicinity of the catholyte liquor inlet (outlet) provided on a cathode plate is shaved off and FIG. 11 (B) is a schematic illustration exhibiting a cathode plate on which a concave-convex-shaped packing is placed.
Figure 11B:
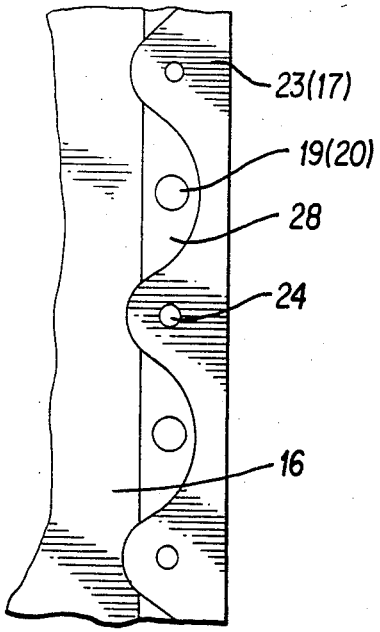

Next, a caustic soda-shielding plate (25) having bolt holes (24), said packing (23) and the membrane (3) are placed in such an order. Then, on one long side of the cathode plate is the catholyte liquor inlet (19) provided on the opposite long side is the mixed stream outlet (not shown) provided. As the foregoing bolt holes, existing bolt holes of the bottom plate in the mercury electrolytic cell may be directly served but changes in diameter, angle, and the like are of course possible and those are also newly made. Moreover, when a part of the cathode plate near the concave portion of the packing (23) is shaved off (28), as depicted by FIG. 11(A) to thus form a space greater than the neighborhood, the pressure resulting from introduction of catholyte liquor or removal of the mixed stream may be made uniform and flow of catholyte liquor may be made uniform over the cathode plate. FIG. 11(B) is a schematic illustration of a cathode plate (16) having a shaved portion (28) with a concave-covex-shaped packing (23) thereon.

Figure 12:
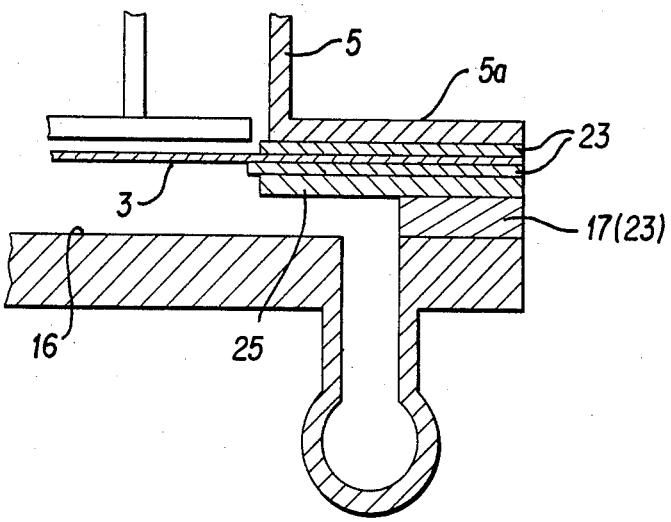
FIG. 12 is an enlarged sectional view of the principal portion in the vicinity of a caustic sode-shielding plate.

In the present invention, as illustrated by FIG. 11(A) and FIG. 12, when a caustic soda-shielding plate (25) is positioned between the cathode compartment side walls (17) and the membrane (3) having the same size with or somewhat larger size than flanges of the anode compartment side walls permitting it to protrude into the cathode compartment, deposition of an electrolyte of anolyte solution onto the membrane may be avoided.

The caustic soda-shielding plate (25) functions as a shield preventing NaOH from migration into the anolyte solution side and therefore is made of caustic soda-resistant materials having a moderate rigidity sufficient to keep contact with the membrane. For example, iron plates, stainless plates, plastic plates such as fluorocarbon resins, hard rubber plates, lined rigid plates and the like may be used. When an iron plate is used, it is desirable to hold it in base potential by, for example, connecting electrically to the cathode plate in order to prevent dissolution of iron. With a metallic plate such as stainless, a packing is preferably inserted between the membrane and the shielding plate, in contrast, with a plastic or hard rubber plate, a packing is not necessarily required. It is preferred as indicated by FIG. 12 that the shielding plate is positioned so as to be substantially the same surface with the inside of the flange (5*a*) of the anode compartment side wall (5) or to somewhat protrude into the cathode compartment. In cases where it is too large, an electrolysing portion of the membrane is shielded and, in contrast, in cases where too small, an adequate shielding effect is not obtained. The caustic soda-shielding plate provides another function of protecting the membrane from excessive positive pressure and further from damage owing to changes in pressure caused at the mixed stream outlet and negative pressure.

Figure 13:
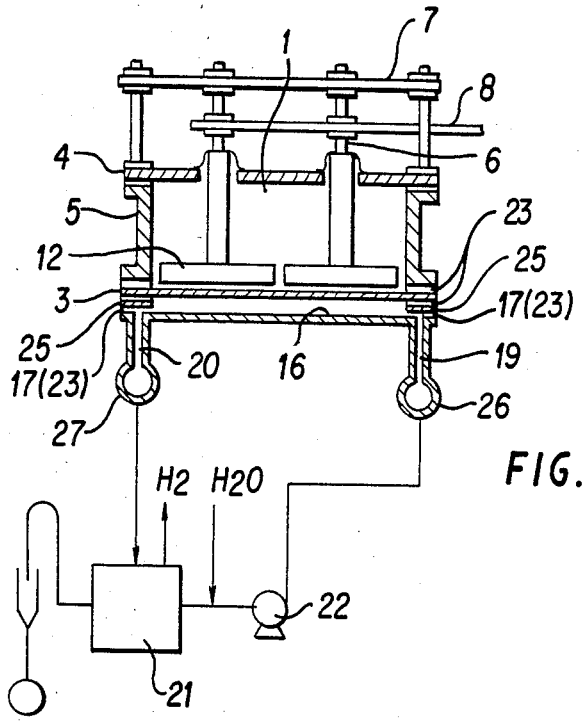
FIG. 13 is a schematic illustration showing a circulating system of catholyte liquor.

In FIG. 13, there is depicted a catholyte liquor circulating system when electrolysing by an electrolytic cell shown by FIG. 8 and FIG. 9, to which a caustic soda-shielding plate is further provided.

In those figures, an anode compartment (1) is formed by being surrounded by a top cover (4), side walls (5) of the anode compartment provided so as to enclose a plurality of anode conducting rods (6) and anode plates (12) suspended from the top cover and the upper side of a cation exchange membrane (3) positioned by being sandwiched between the lower flange of anode compartment side walls (5) and cathode compartment side walls (not shown). The anodes conducting rods (6) are suspended vertically by anode-suspending devices (7) located protruding at the top cover (4) and connected to each other by a bushbar (8). The anode compartment (1) is provided with an anolyte solution inlet (13), an anolyte solution outlet (14) and an anode gas outlet (15).

On the other hand, a cathode compartment (2) is formed by being surrounded by a cathode plate (16), directly diverted from a bottom plate of a mercury electrolytic cell, having a substantially flat surface, cathode compartment side walls positioned at the periphery of the cathode plate (16) and the underside of the cation exchange membrane (3). The cathode plate (16) is connected to a cathode busbar (18). The cathode compartment (2) is provided with a catholyte liquor inlet (19) and an outlet (20) of a mixed stream of catholyte liquor and cathode gas, which are in communication with a catholyte liquor introduction header (26) and a mixed stream removal header (27), respectively.

An approximately saturated brine is supplied through the anolyte solution inlet (13) into the anode compartment (1) and then electrolysed therein. Chlorine gas generated is removed through the anode gas outlet (15) and depleted brine is discharged through the anolyte solution outlet (14).

The depleted brine, if necessary, may be partly recirculated to make concentration and pH of brine uniform in the anode compartment. Moreover, although not shown in the figures, uniformity of anolyte solution in the anode compartment may also be attained by providing an anolyte solution supplying pipe with perforations, extending over the full length of the anode compartment, and supplying it through the perforations.

The catholyte liquor is supplied through the catholyte liquor inlet (19) into the cathode compartment (2) and mixed with hydrogen gas evolved in the cathode compartment to provide a mixed stream, discharged through the outlet (20) of the mixed stream, then the mixed stream being transported to a separator (21) in which hydrogen gas is separated from caustic liquor. The catholyte liquor containing substantially no hydrogen gas is recirculated by use of a pump (22) through the catholyte liquor inlet (19) to the cathode compartment (2).

The separator (21) and the pump (22) may be one, respectively, for a plurality of cells, otherwise, for each cell.

Moreover, using a plurality of cells connected in series, the mixed stream removed through the outlet (20) may be supplied as catholyte liquor to a successive cell after separation from hydrogen gas. This process reduced a total amount of catholyte liquor recirculated when a plurality of cells are used, thereby giving numerous advantages such as decrease in equipment cost and energy cost for circulation of catholyte liquor.

Furthermore, it is possible to cause flow of catholyte liquor to make a U-turn by a partition provided in the cathode compartment. There is no limitation on the number of U-turn and catholyte liquor may be caused to make a U-turn in the cathode compartment or may be removed once, then turned similarly. In this case, the U-turn may be accompanied by gas-liquid separation at that spot or may be made without such separation. By such U-turn of catholyte liquor, an amount of catholyte liquor recirculated per cell can be reduced with advantages as aforesaid.

Still more, upon the U-turn of catholyte liquor by the use of a cell providing the catholyte liquor inlet and the mixed stream outlet to the same long side of the cell, if the inlet is provided to a periphery of the cathode plate and the outlet is to a flange of an anode compartment side wall or vice versa, pipe arrangement may be made systematically and practically.

The electric current is supplied to an anode busbar (8), passed through the bottom plate (16) of the cathode compartment (2) and then taken out from a cathode busbar (18).

In the anode compartment (1), the following reaction takes place;

$$Cl^- \xrightarrow{-e} \tfrac{1}{2}Cl_2$$

Sodium ions in the anode compartment (1) move through the cation exchange membrane (3) to the cathode compartment (2). In the cathode compartment (2), on the other hand, the following reaction occurs;

$$H_2O \xrightarrow{+e} \tfrac{1}{2}H_2 + OH^-$$

In the cathode compartment sodium hydroxide is produced by reaction of hydroxyl ions with sodium ions transported through the cation exchange membrane (3) from the anode compartment (1), concurrently with evolution of hydrogen gas.

In the electrolysis using a cation exchange membrane, a vertical type cell is commonly employed. In this case, hydrogen gas generated in the cathode compartment is rapidly removed behind the cathode (i.e., to an apposite direction to the cation exchange membrane), and hence a porous cathode fabricated of expanded metal sheets, perforated metal sheets, metal nets and the like with a view to reducing electric resistance of the catholyte liquor may be used.

Nonetheless, in the case of a horizontal type cell it is impossible to remove hydrogen gas with a small specific gravity behind the cathode, i.e., under the cathode located extending to a horizontal way.

Therefore, the greatest feature of the present invention lies in that into the cathode compartment comprised of the underside of the cation exchange membrane (3) and the cathode plate (16) with gas-liquid impermeability positioned adjacent thereto, catholyte liquor is supplied and the cathode compartment is filled therewith to thus form a mixed stream of catholyte liquor and cathode gas, with which the underside of the cation exchange membrane (3) is wetted to allow the electrolysis reaction to take place smoothly, at the same time, sodium hydroxide and hydrogen gas produced in a space between the cation exchange membrane (3) and the cathode plate (16) are enfolded in the stream, then discharged outside the cathode compartment (2).

It is advantageous to recirculate back to the catholyte liquor inlet (19) at least a part of the catholyte liquor which is supplied into the cathode compartment, removed together with hydrogen gas and caustic soda produced and then separated from hydrogen gas by the separator (21), since the concentration of caustic soda can be increased optionally and adjusted by being diluted with water.

Figure 14:
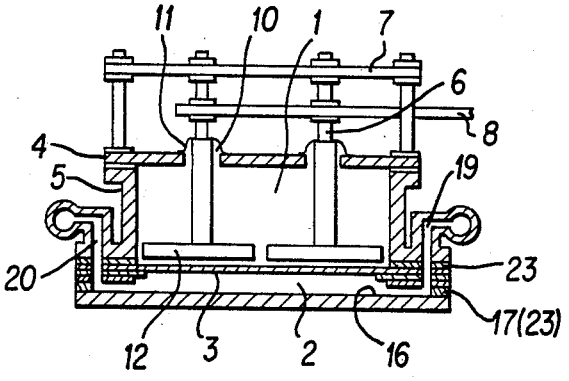
FIG. 14 is a side sectional view of an electrolytic cell in which the catholyte liquor is introduced and removed through flanged portion of the anode compartment side wall.
Figure 15:
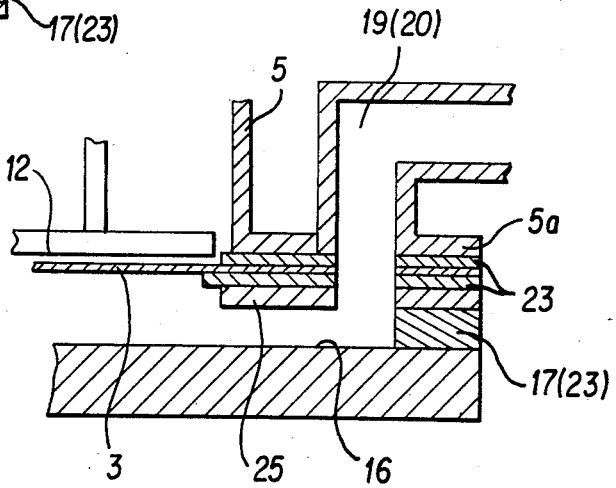
FIG. 15 is an enlarged sectional view of the principal portion of FIG. 14.

FIG. 14 is a side sectional view of an electrolytic cell in which catholyte liquor is introduced and removed through flanged portion of the anode compartment side wall, and FIG. 15 is an enlarged view of the principal portion of FIG. 14. Although not shown by figures, it is also possible that catholyte liquor is introduced through a periphery of the cathode plate and removed through a flange of the anode compartment side wall, and vice versa.

Hereinafter the present invention will be explained in more detail by way of Examples that follow, to which the invention is in no way limited.

EXAMPLE 1

As a cation exchange membrane, "NAFION 901 (Registered trademark, manufactured and sold by E. I. Du Pont de Nemours & Company)" was positioned substantially horizontal between both anodic and cathodic electrodes of a horizontal electrolytic cell having the length of 11 m and the width of 1.8 m. As the anode, a titanium expanded metal sheet whose surface was coated with $RuO_2$ and $TiO_2$ was used and as the cathode an iron plate whose surface was subjected to plasma flame spray with nickel was used.

Said cathode plate possessed ditches, 8 mm in depth and 8 mm in width, running parallel to the longitudinal direction at an interval of 16 mm and situated so as to keep convexities formed between adjacent ditches opposing to the membrane with a distance of about 1 mm. Catholyte liquor was recirculated in the longitudinal direction.

In an anode compartment, concentration of NaCl was controlled to 3.5N, in a cathode compartment, concentration of NaOH was controlled to 32% and the temperature was controlled to 85±2° C.

Figure 5:
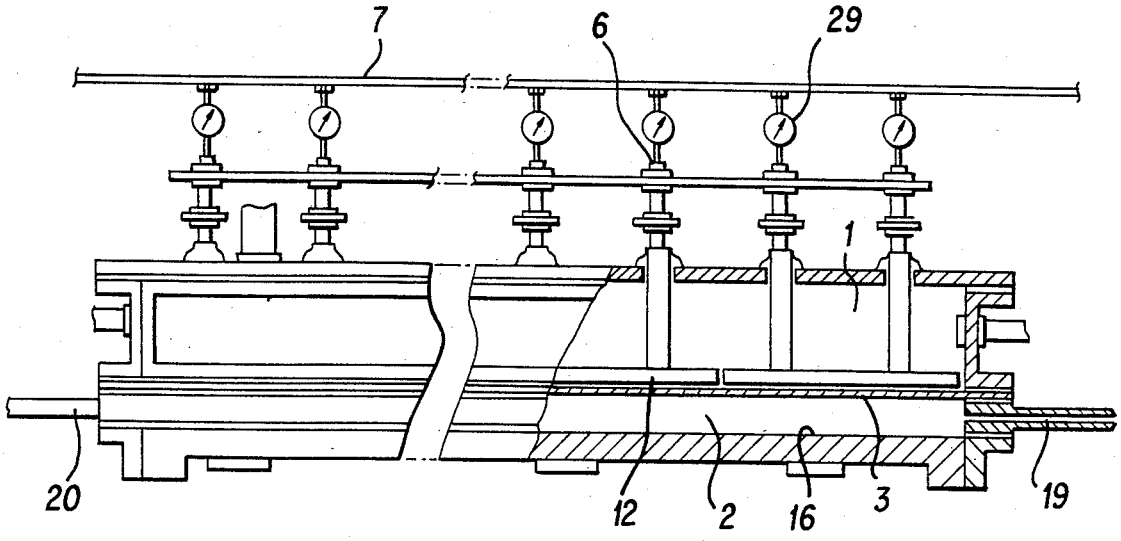
FIG. 5 illustrates an apparatus for measuring vibration of anodes in which dial gauges are provided to an electrolytic cell.
Figure 6:
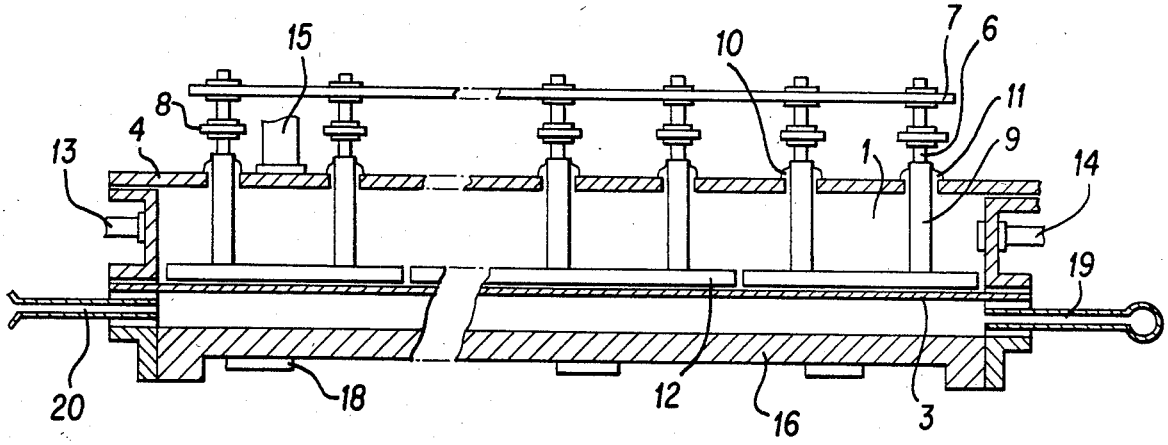
FIG. 6 is a partial cutaway front view illustrating an embodiment of the present horizontal type electrolytic cell.
Figure 7:
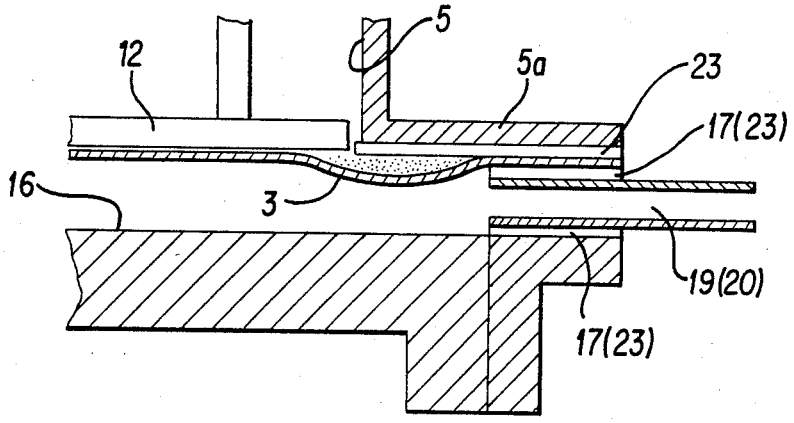
FIG. 7 is a schematic illustration showing deposition of NaCl.

Vibration of the anode was measured by dial gauges (29) provided to anode conducting rods (6), as shown by FIG. 5. That is, a distance between a bar having the given height and the upper end of the anode conducting rod was measured by gauges and jolting was observed.

With current density of 20 A/dm$^2$, an amount of catholyte liquor recirculated (hereinafter referred to as "recirculation amount") was varied from 20 m$^3$/Hr (initial linear velocity: 60 m/sec) to 50 m$^3$/Hr (150 m/sec). No vibration of anodes occurred. Under these conditions, gas content at the outlet was from 0.53 to 0.30. Operation could be continued for one month without any trouble.

COMPARATIVE EXAMPLE 1

With current density of 30 A/dm$^2$, the recirculation amount was varied to 20, 30 and 50 m$^3$/Hr, the other conditions being the same as in Example 1.

No vibration of anodes was observed with the recirculation amount of 30 and 50 m$^3$/Hr, but with 20 m$^3$/Hr, anodes in the neighborhood of a catholyte liquor outlet vibrated. Gas content at the outlet was 0.62.

After one-month continuous operation, the membrane was inspected and small pin holes were observed in the vicinity of the catholyte liquor outlet.

COMPARATIVE EXAMPLE 2

Electrolysis was effected similarly to Example 1, except that the recirculation amount was 20 m$^3$/Hr, with current density of 40 A/dm$^2$.

Vibration of anodes situated from about 9 meters from a catholyte liquor inlet to the outlet was observed. With anodes approaching to the outlet, vibration became violent. Gas content at a spot, 9 meters apart from the inlet was 0.64, and at the outlet, 0.69.

After 20-day continuous operation, concentration of hydrogen contained in chlorine gas increased to 0.7% and operation was thus ceased. The membrane was observed and occurrence of pin holes was seen. Especially, at the outlet of catholyte liquor cracks of about 1.5 cm were present.

EXAMPLE 2

In Comparative Example 2, the recirculation amount was increased from 20 m$^3$/Hr to 33 m$^3$/Hr. Vibration of anodes was not observed at all. Gas content was 0.57.

COMPARATIVE EXAMPLE 3

With exception that using a cathode plate having a flat surface, the anode-cathode distance was 4 mm, electrolysis was carried out in a similar manner to that of Example 1.

Operation was performed at the recirculation amount of 20 m$^3$/Hr (initial linear velocity: 78 cm/sec) with current density of 40 A/dm$^2$, vibration of anodes situated from about 9.5 meters from the catholyte liquor inlet to the outlet was found. Gas content at that spot was 0.65.

EXAMPLE 3

In Comparative Example 3, operation was carried out by increasing the recirculation amount from 20 m$^3$/Hr to 35 m$^3$/Hr. No vibration of anodes was found. Gas content was 0.56.

EXAMPLE 4

"NAFION 901" served as a cation exchange membrane, was positioned substantially horizontal over a substantially flat cathode plate comprising a bottom plate of a mercury electrolytic cell whose surface was subjected to plasma flame spray with nickel, having the length of 11 m and the width 1.8 m. Said cathode plate was provided with partitions of a soft rubber, 2.5 mm high and 7 mm wide, arranged at an interval of 30 cm in the traverse direction to the longitudinal way of the cathode plate and the top of the partitions was brought into contact with the membrane.

As an anode, a DSE for use in a mercury electrolytic cell, i.e. a titanium expanded metal sheet whose surface was coated with $RuO_2$ and $TiO_2$ was used and situated so as to bring a working surface of the anode into contact with the membrane. Electrolytic cell so constructed and an operation system were such as shown by FIG. 8, FIG. 9 and FIG. 13, though partitions were further provided on the cathode plate shown by FIG. 8.

In an anode compartment, a part of depleted brine was recirculated to control concentration of the depleted brine to 3.5N, while in a cathode compartment a part of catholyte liquor was recirculated to control concentration of caustic soda to 32% with the initial linear velocity of 50 cm/sec. The temperature was maintained at 85° C.

During the operation, cell voltage was stable, exhibiting 3.12 V with current density of 30 A/dm$^2$, ΔCV was zero, current efficiency was 96% and the content of NaCl in caustic soda was 35 ppm/50%NaOH. Δp at a catholyte liquor inlet was 0.05 kg/cm$^2$ and operation was continued for three months without any change in performances. After operation, the membrane was inspected but no disorder was observed.

COMPARATIVE EXAMPLE 4

Excepting that using an electrolytic cell equipped with a cell cover, a cathode plate and a DSE, reinforced respectively, catholyte liquor was recirculated with the initial linear velocity of 1.2 m/sec in the longitudinal direction of the cell, operation was conducted similarly to Example 4.

Cell voltage was raised to 3.18 V at an outlet of a mixed stream while it was 3.12 V at an inlet of catholyte liquor. Current efficiency was 96% and NaCl of 35 ppm/50%NaOH was contained in caustic soda. Δp at the inlet was 0.3 kg/cm$^2$ and after two-month continuous operation, small cracks were observed on the membrane.

EXAMPLE 5

As a cation exchange membrane, "NAFION 901" was used and positioned substantially horizontal to a horizontal electrolytic cell provided with a cathode plate having a working surface, 11 m long and 18 m wide. The cathode plate possessed ditches, 6 mm deep and 8 mm wide at an interval of 16 mm, running parallel to the longitudinal direction and situated so as to bring the convexities formed between adjacent ditches into contact with the membrane.

As an anode, a titanium expanded metal sheet whose surface was coated with $RuO_2$ and $TiO_2$ was used and situated to come in contact with the upper surface of the membrane.

Catholyte liquor was recirculated at 30 $m^3$ per hour (initial linear velocity: about 1.5 m/sec) and difference in pressure imposed on the membrane between the cathode compartment and the anode compartment at the vicinity of the catholyte liquor outlet was controlled to 0.5 m $H_2O$ by adjustment of a value provided to the outlet.

Into an anode compartment, was substantially saturated NaCl brine supplied and concentration of depleted brine was controlled to 3.5N. Catholyte liquor was controlled to keep concentration of 32% by addition of water. The temperature was maintained at 85° C.

During one-month continuous operation with current density of 30 $A/dm^2$, an average cell voltage was 3.20 V and current efficiency was 95.3%. An average value of difference in pressure imposed on the membrane was approximately 0.2 m $H_2O$, with maximum value of 0.35 m $H_2O$. After one-month continuous operation, the membrane was inspected but no disorder was present.

COMPARATIVE EXAMPLE 5

Operation was performed in a similar fashion to that of Example 5, except that difference in pressure imposed on the membrane was 0.05 m $H_2O$, with the valve at the outlet nearly opend.

After one-week continuous operation, cracks occurred on the membrane near the outlet.

EXAMPLE 6

A cation exchange membrane "NAFION 901" was opsitioned substantially horizontal over a substantially flat cathode plate comprised of a bottom plate of a mercury electrolytic cell having the length of 11 m and the width of 1.8 m, the surface of which was subjected to plasma flame spary with nickel. On the cathode plate partitions of a soft rubber, 2.5 mm high and 7 mm wide, were arranged in parallel at an interval of 35 cm, in the traverse direction to the longitudinal way of the cathode plate, and the top of the partitions are caused to be in contact with the membrane. A catholyte liquor inlet and a mixed stream outlet were provided to each unit formed by adjacent partitions by the use of branch pipes. As a caustic soda-shielding plate, a stainless steel plate was served.

As an anode, a DSE for use in a mercury electrolytic cell, i.e., a titanium expanded metal sheet whose surface was coated with $RuO_2$ and $TiO_2$ was employed and situated so as to bring a working surface of the anode into contact with the membrane. The cell so constructed and a catholyte liquor recirculating system were shown in FIG. 8, FIG. 9 and FIG. 13, excepting the partitions.

In an anode compartment, a part of depleted brine was recirculated and concentration of the depleted brine was controlled to 3.5N, whereas in a cathode compartment, a part of catholyte liquor was recirculated to keep concentration of 32% with the initial linear velocity of 50 cm/sec. The temperature was maintained at 85° C.

Cell voltage was kept stable, showing 3.12 V with current density of 30 $A/dm^2$, current efficiency was 96% and the content of NaCl was 35 ppm/50%NaOH. Operation was continued for one month but neither an increase in $\Delta p$ nor deposition of NaCl, nor vibration nor damage of the membrane was observed.

COMPARATIVE EXAMPLE 6

Electrolysis was conducted similarly to Example 6, with exception that the caustic soda-shielding plate was not used.

After ten-day operation, an increase in $\Delta p$ appeared, then operation was ceased. The cell was disassembled and inspected. On the membrane at the anode compartment side over the inlet and outlet of catholyte liquor, NaCl deposited and plugged the inlet.

As was stated earlier, the present invention is capable of converting mercury electrolytic cells to cation exchange membrane electrolytic cells very feasibly, and therefore almost all existing equipments including busbars, rectifiers, disposal equipments of depleted brine and brine system equipments as well as electrolytic cells can be diverted without being scrapped. The present invention further prevents troubles due to deposition of NaCl, occurrence of a pulsating flow resulting from an increase in $\Delta p$ and $G/(L+G)$, and damage of the membrane while maintaining cell voltage low and constant, and is therefore very advantageous in practice.

What we claim is:

1. In a process for electrolyzing an aqueous alkali metal halide solution using a horizontal type electrolytic cell partitioned by a cation exchange membrane positioned substantially horizontal in the cell and dividing the cell into an upper anode compartment and lower cathode compartment, the improvement which comprises using a cell with a cathode compartment having a gas-liquid impermeable cathode plate and carrying out the electrolysis while maintaining an initial linear velocity of catholyte liquor in the cathode compartment at not less than 8 cm/sec and a gas content in the electrode compartment adjacent to a catholyte liquor outlet at not more than 0.6, wherein the gas content in the cathode compartment is a ratio of cathode gas to a mixture of cathode gas and catholyte liquor which is represented by R in the following equation:

$$R=G/(L+G)$$

wherein G is an amount of cathode gas generated ($m^3$/Hr) and L is the flow rate ($m^3$/Hr) of the catholyte liquor.

2. The process of claim 1, wherein the cathode plate and the cathode compatment have a rectangular cross-section and the catholyte liquor is introduced through a long side of the cathode compartment into the cathode compartment, a mixed stream of cathode gas and catholyte liquor is formed which the underside of the membrane is wetted, and the mixed stream is removed through the opposite long side of the cathode compartment.

3. The process of claim 1 or claim 2, wherein at least a part of the mixed stream is, after gas-liquid separation, recirculated as catholyte liquor to the cathode compartment.

4. The process of claim 1, wherein the electrolysis is carried out while pressing the membrane against an anode.

5. The process of claim 1 or claim 2, wherein the catholyte liquor is introduced through a flange of a side wall of the anode compartment or a periphery of the cathode plate opposite the flange in the substantially vertical direction to the horizontal surface of the cathode plate, and the mixed stream of cathode gas and catholyte liquor is removed through another flange of a side wall of the anode compartment or another periphery of the cathode plate in the substantially vertical direction to the horizontal surface of the cathode plate.

6. The process of claim 5, wherein the electrolysis is carried out while preventing deposition of an electrolyte of anolyte solution on a liquid-contacting and electricity-nonpassing portion of the membrane.

7. An electrolytic cell for electrolysis of an aqueous alkali metal halide solution, comprising an upper anode compartment and lower cathode compartment partitioned by a cation exchange membrane positioned substantially horizontal in the cell, the anode compartment having therein substantially horizontal anodes and being surrounded by a top cover, side walls positioned so as to enclose the anodes and an upper side of the membrane, and being provided with inlet means for supplying anolyte solution and outlet means for removing anolyte solution and anode gas, and the cathode compartment being provided with a cathode plate, side walls so as to enclose the cathode plate and an underside of the membrane, inlet means for supplying catholyte liquor and outlet means for removing catholyte liquor, wherein the cell is retrofitted from a mercury electrolytic cell having a rectangular cross-section, the cathode plate is substantially flat and gas-liquid impermeable and forms a bottom wall of the cathode compartment, the inlet means for supplying catholyte liquor is located at the cathode plate or a side wall thereabove along a long side of the rectangular cathode compartment, the inlet means for supplying catholyte liquor providing a mixed stream of cathode gas and catholyte liquor by supplying the catholyte liquor flow at a speed sufficient to rapidly enfold cathode gas into catholyte liquor; and the outlet means for removing catholyte liquor is located at the cathode plate or a side wall thereabove along the opposite long side of the cathode compartment, the outlet means for removing catholyte liquor also removing cathode gas from the cell as a mixed stream with catholyte liquor.

8. The electrolytic cell of claim 7, wherein a means is provided for separating the mixed stream removed from the outlet means into gas and liquor, and a means is provided for recirculating catholyte liquor separated from cathode gas to the inlet means for supplying catholyte liquor.

9. The electrolytic cell of claim 7, wherein the inlet means for supplying catholyte liquor and the outlet means for removing the mixed stream of catholyte liquor and cathode gas are provided, respectively, to flanges of side walls of the anode compartment or peripheries of the cathode plate opposite the flanges, so that the catholyte liquor is introduced and said mixed stream is removed in the substantially vertical direction to the horizontal surface of the cathode plate.

10. The electrolytic cell of claim 9, wherein the cathode plate and the flanges of the side walls of the anode compartment have bolt holes, and the inlet means for supplying catholyte liquor and the outlet means for removing the mixed stream include some of the bolt holes.

11. The electrolytic cell of claim 10, having a packing for a side wall of the cathode compartment, the packing having a concave-convex shape in its inside periphery and being provided on the peripheries of the cathode plate comprising the bottom wall, the concave portions of the packing are located at bolt holes of the cathode plate which are part of the inlet means for supplying catholyte liquor and outlet means for removing the mixed stream, and the convex portions of the packing are located on bolt holes which assemble the cell.

12. The electrolytic cell of claim 7, wherein a caustic soda-shielding plate is positioned between the membrane and the side walls of the cathode compartments and is approximately the same in size with, or somewhat larger than, flanges of side walls of the anode compartment permitting it to protrude into the cathode compartment.

13. The electrolytic cell of claim 7, wherein the means for supplying catholyte liquor include means for supplying catholyte liquor at 8 cm/sec or more.

* * * * *